US005792001A

United States Patent [19]

Henwood

[11] Patent Number: 5,792,001

[45] Date of Patent: Aug. 11, 1998

[54] PUTTING STROKE TRAINING DEVICE

[76] Inventor: Richard Henwood, 1496 Paloma Pl., Arroyo Grande, Calif. 93420

[21] Appl. No.: 680,658

[22] Filed: Jul. 16, 1996

[51] Int. Cl.[6] ..... A63B 69/36

[52] U.S. Cl. ..... 473/224; 473/220; 473/234; 473/223

[58] Field of Search ..... 473/220, 222, 473/224, 234

[56] References Cited

U.S. PATENT DOCUMENTS

| | | | |
|---|---|---|---|
| 3,848,873 | 11/1974 | Lees . | |
| 4,148,096 | 4/1979 | Hass et al. . | |
| 4,930,787 | 6/1990 | Nobles, Jr. . | |
| 5,131,660 | 7/1992 | Marocco . | |
| 5,161,802 | 11/1992 | Daechsel . | |
| 5,169,151 | 12/1992 | Conley . | |
| 5,184,826 | 2/1993 | Hall, Jr. . | |
| 5,441,269 | 8/1995 | Henwood . | |
| 5,492,329 | 2/1996 | Kronin | 473/223 X |

*Primary Examiner*—George J. Marlo
*Attorney, Agent, or Firm*—Coudert Brothers

[57] ABSTRACT

The critical features of the improved putting stroke training device of the present invention includes a Y-axis sensor means using a convertor for converting mechanical energy to electric energy for detecting and signalling whether the face of a putter strikes a golf ball perpendicular to the path of the putter head and X-axis sensor means for detecting and signalling any abnormal acceleration or deceleration of the putter head. The Y-axis sensor means is disposed in a Y plane that is perpendicular to the golf ball striking face. The X-axis sensor means is disposed in an X plane that is perpendicular to the Y plane and is in the same plane as the shaft. This putting stroke trainer will assist the golfer in striking the ball with the club face perpendicular to the path of the putter head, and in developing a smooth pendulum swing and avoiding the "yips".

33 Claims, 6 Drawing Sheets

PUTTING STROKE TRAINING DEVICE

FIELD OF THE INVENTION

This invention relates generally to the field of golf club training devices. More specifically, the invention is directed to an improved putting stroke training device to develop a smooth, consistent putting stroke by alerting the golfer when the putter head has accelerated or decelerated too rapidly or when the golfer opens or closes the club face when striking a golf ball.

BACKGROUND OF THE INVENTION

Many golf club training devices have been developed over the years; see U.S. Pat. Nos. 3,848,873; 4,148,096; 4,930,787; 5,131,660; 5,161,802; 5,169,151; and 5,184,826. Of these U.S. Pat. Nos. 4,930,787; 5,131,660; 5,161,802; 5,169,151 and 5,441,269 are directed to putter training devices.

U.S. Pat. No. 4,930,787 teaches a device that produces a signal if the club head is rotated out of parallel with the horizon or the club head undergoes clockwise or counter-clockwise rotation on the backstroke.

U.S. Pat. No. 5,131,660 discloses and claims a putter having an encoder wheel with a pendulum that rotates in response to the pendulum's rotation and a microprocessor/signal means for calculating the distance a golf ball travels when struck by a given backstroke.

U.S. Pat. No. 5,161,802 discloses and claims a golf club, including a putter, having means for generating a light beam parallel to the axis of the shaft in a direction away from the handle. The club produces a visual indication of the path of the ball in response to the manner in which the golfer makes a golf stroke. This enables the golfer to determine the accuracy of the stroke and the squareness of the club head to the target line.

U.S. Pat. No. 5,169,151 discloses and claims an electro-mechanical putting trainer in which an inertial sensor responds to the axial rotation during the backstroke of the putter. If the golfer allows the putter to rotate around the longitudinal axis of the putter's shaft, an alarm will sound.

A few of the putter training devices disclosed in the prior art are directed to correcting the problem of hitting the ball squarely, i.e. the ball must strike the face of the club perpendicular to the path of the club. However, except for Richard Henwood's putter stroke training device over which the present invention is an improvement and which is discussed below, none of the previous of the prior art attempts to correct the problem of "yips" which is common to high handicap, low handicap as well as professional golfers. "Yips" have been defined as:

(1) Accelerating too quickly on the backstroke, during the transition stroke between the backstroke and the forward stroke, or during the forward stroke; and (2) Decelerating during the transition stroke or during the forward stroke.

Richard Henwood, U.S. Pat. No. 5,441,269 solved the need for a putting trainer device to train the golfer to strike the ball with the club face perpendicular to the club as well as to impart to the golfer a smooth pendulum swing with the proper tempo and thus avoiding the "yips".

SUMMARY OF THE INVENTION

The putting stroke training device of the present invention is an improvement over the putter training device disclosed and claimed in U.S. Pat. No. 5,441,269. The basic elements of the device of the '269 patent and the present improvement are the same and comprise an elongated shaft and a head having a sole plate, a top and a ball striking face substantially perpendicular to the sole plate, Y-axis sensor means for electronically detecting and signalling whether or not a user putts so that the head strikes a golf ball perpendicular to the path of the head, X-axis sensor means for electronically detecting and signalling any abnormal acceleration or deceleration of the putter head, and a module for attaching each of the sensors to the putter. The module contains a printed circuit board (PCB) for an electronic circuit that operates the sensor means and other electronic components of the device of this invention. The module can either be housed within the putter head itself or mounted on the top of the putter head. The Y-axis sensor means is disposed in a Y plane that is perpendicular to the golf ball striking face. The X-axis sensor means is disposed in an X plane that is perpendicular to the Y plane and is in the same plane as the shaft.

The improvement to the putter of the '269 patent is to use a Y-axis sensor means comprising first and second light emitting diodes connected in an electronic circuit to give a visual signal to the user whether the ball striking face of the putter strikes a golf ball perpendicular to the path of the putter head, and an impact detecting means for detecting the magnitude of energy and means for interpreting whether the face is in an open position, a closed position, or the proper position. The impact detecting means is mounted within the mounting block and includes an energy absorbing material for absorbing the mechanical energy generated by an on-axis impact of the ball with the club face and a converter means for converting mechanical energy into electrical energy by generating an electrical signal across a pair of terminals operably connected to the electronic circuit in response to such energy. The Y-axis sensor means is designed so that the mechanical energy absorbing material absorbs and attenuates substantially all of the mechanical energy when the putter face is in the proper position and the ball hits against the face along the X-axis and the electronic circuit maintains the first light emitting diode in an on-position. On the other hand, when the face is in an open or a closed position, the ball impacts the striking face off the X-axis, the sensor means detects any Y-axis mechanical energy and vibrations are generated in the converter means to be converted into sufficient current to cause the second light emitting diode to be in the on-position.

The improved putting stroke training device of this invention also includes switch means for activating the X-axis and Y-axis sensor means so that the putter can be used as a training device or as a conventional putter when the switch is respectively turned on and off. The switch means is an ON-OFF electrical switch or contact mounted on the shaft of the club.

Light emitting diodes (LED's) form part of the Y-axis sensor means to give a visual signal to the user. A buzzer, beeper or other audible alarm forms part of the X-axis sensor and is combined with the LED's of the Y-axis sensor to give an audible signal that is clearly distinguishable to the user from the visual signal of the LED's. The LED signal indicates to the user whether or not the ball striking face strikes the ball perpendicular to the path of the head. The audible signal indicates to the user when the head is accelerating or decelerating abnormally.

Each of the foregoing features of this invention will be more fully described below with reference to the following set of drawings.

DETAILED DESCRIPTION OF THE PREFERRED EMBODIMENT

Figure 7:
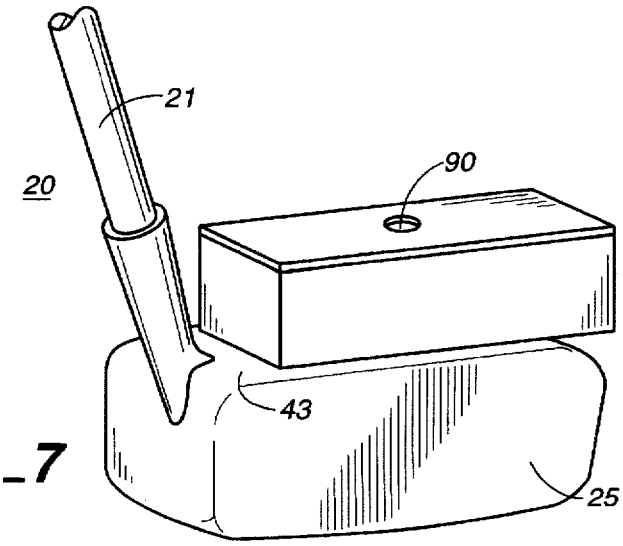
FIG. 7 is a top, front and left side perspective view of another embodiment of the device of the present invention.

Turning now to FIGS. 1A–1B, 2, 2A–2D, and 3, a preferred embodiment of the present putting stroke training device is illustrated comprising putter 20 having elongated shaft 21, grip 23 and head 24 having ball striking face 25 and sole plate 27. Although putter 20 is for left handed golfers, it is apparent that the training device of this invention is equally adaptable for right handed golfers. Y-axis sensor 29 and X-axis sensor or pendulum sensor 30 are housed within module 31 which is either operably mounted within head 24 as shown in FIG. 1 or is fixedly attached on head 24 as shown in FIG. 7.

X-axis sensor 30 is similar to that disclosed and claimed in the '269 patent and comprises pendulum actuator 32 having pendulum 33 and fulcrum 34 rotatably mounted within module 31. Fulcrum 34 is positioned within grooves 35 in top 36 of module 31 so that it is along the Y-axis and parallel to striking face 25. Pendulum 33 is fixedly attached to fulcrum 34 and is along the Z-axis and perpendicular to sole plate 27. The remaining essential elements of X-axis sensor 30, shown in FIG. 3, include emitter 37 and detector 38 which are mounted in floor 39 of module 31. Emitter 37 comprises a light emitting diode, LD1, and detector 38 comprises a photo-transistor, PT1, of the electronic circuit shown in the FIG. 8. Appropriate terminal designations 37A, 37B, 38A, and 38B operably connect emitter 37 and detector 38, respectively within the electronic circuit shown in the FIG. 8.

Sole plate 27 is normally positioned on the putting surface with shaft 21 substantially perpendicular to the surface of the putting green and with striking face 25 perpendicular to the path a golf ball will take to the hole, cup or other ball target. When putter 20 is in this position, pendulum 33 is in its "proper" or closed position. Pulses of light from emitter 37 to detector 38 form the optical-electric function of the X-axis sensor 30. Pendulum 33 hangs from grooves 35 in a manner to completely block the pulses of light between emitter 37 and detector 38, which are positioned along the Y-axis. When a golfer causes head 24 to move in other than a smooth pendulum-like swing, pendulum 33 swings along the X-axis. The position of pendulum 33 is interrogated by the IR pulses of light and an electric signal will be sent through the circuitry shown in FIG. 8 to cause buzzer 40 within grip 23 of shaft 21 to sound. Floor 39 is joined to top 36 of module 31 by posts 42. Bottom 39 of module is the PCB containing the electronic circuit illustrated in FIG. 8.

A non-pendulum-like swing is the result of the golfer bringing head 24 back with a jerky motion or with too much acceleration or deceleration or suddenly stopping head 24 during the transition stroke or bringing head 24 forward with a jerky or decelerating motion. This type of improper swing will cause fulcrum 34 to rotate within grooves 35 of module 31 which in turn causes pendulum 33 to swing out of the path of light between emitter 37 and detector 38. On the other hand, when the golfer uses a proper pendulum-like swing by moving head 24 with the combination of a smooth backstroke, a smooth transition stroke and a smooth forward, stroke pendulum 33 is designed to remain in the proper position, substantially perpendicular to sole plate 27. By using a proper putting stroke, fulcrum 34 will not rotate within grooves 35 and pendulum 33 will remain to continuously block the path of light so that buzzer 40 is silent. Any abnormal acceleration causes buzzer 40 to give off an audible signal, shown in FIG. 1B.

Figure 4:
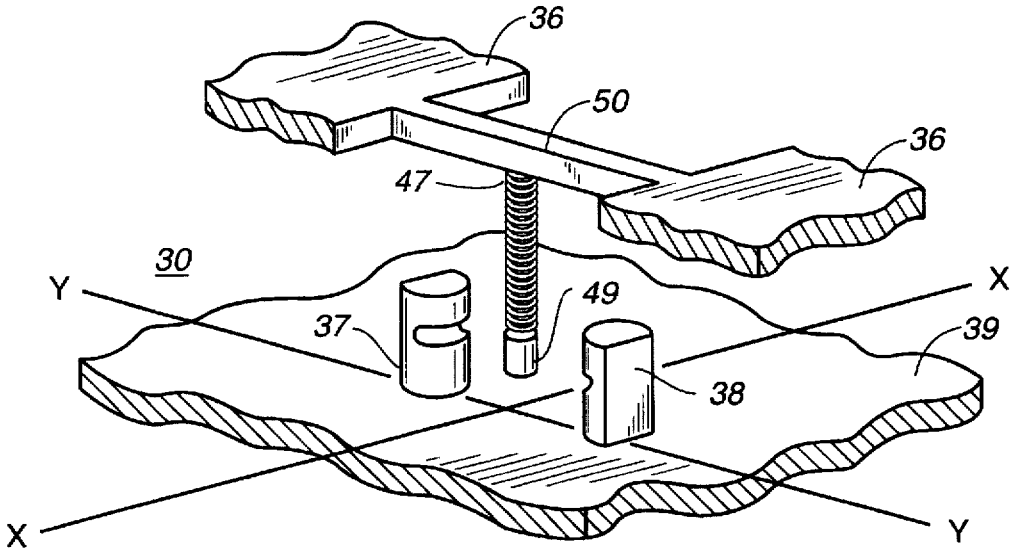
FIG. 4 is a top, front and right side perspective view of the X-axis sensor of another embodiment of the device of the present invention.
Figure 5A:
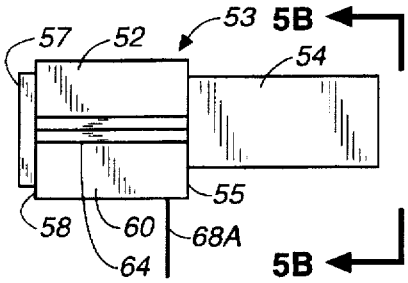
FIG. 5A is a right side view of the Y-axis sensor that is mounted in the module shown in FIG. 2.
Figure 5B:
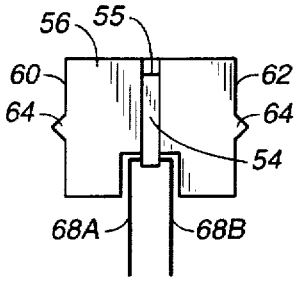
FIG. 5B is a back view of the Y-axis sensor housed that is mounted in the module shown in FIG. 2.
Figure 5C:
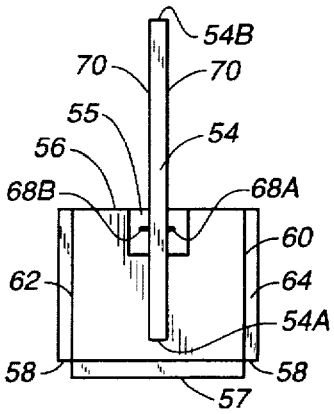
FIG. 5C is a bottom view of the Y-axis sensor that is mounted in the module shown in FIG. 2.
Figure 6A:
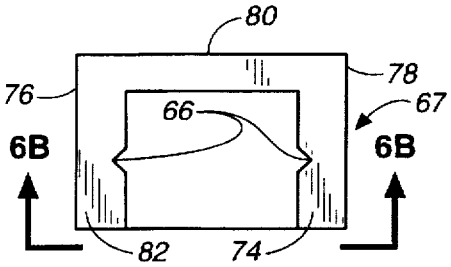
FIG. 6A is a back view of the mounting block that is mounted in the module shown in FIG. 2.
Figure 6B:
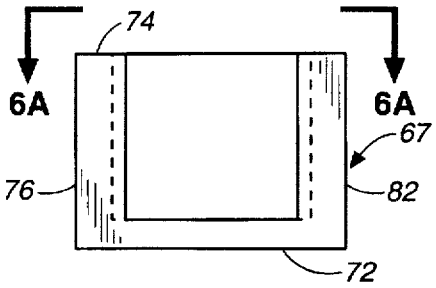
FIG. 6B is a bottom view of the mounting block for the Y-axis sensor that is mounted in the module shown in FIG. 2.

FIG. 4 illustrates another embodiment of X-axis sensor 30 in which pendulum actuator 32 is replaced by spring actuator 45 which comprises spring 47 having weight 49 at one end and fixedly attached at the other end to stationary arm 50 in top 36 of module 31. Stationary arm 50 is fixedly attached to top 36 and is positioned along the Y-axis parallel to striking face 25. The combination of spring 47 and weight 49 serves exactly the same purpose as pendulum 33. A non-pendulum-like swing will cause spring 47 to in turn move weight 49 into interference with the light pulses between emitter 37 and detector 38 mounted to PCB 39 of module 31.

FIGS. 1A–B, 2, 2A–2D, 5A–5C, and 6A–6B illustrates Y-axis sensor a 29 which converts mechanical energy into electrical energy. Converter 53, shown in FIGS. 5A–5C, includes (1) piezo-electric substrate 54 having first end 54A and second end 54B which is fixedly attached to holder 52 at end 54A and partially extends from recess 55 in first end 56 of holder 52 along its horizontal axis and (2) energy absorber 57 fixedly attached to second end 58. In this preferred embodiment, absorber 57 is adjacent to the inside surface of putter striking face 25 of head 24. Substrate 54 from end 54A to 54B is along the horizontal axis and is partially within holder 52 to provide support. Holder 52 has right side wall 60 and left side wall 62. Each side wall 60 and 62 has rail 64 along its midpoint and parallel to the longitudinal axis of holder 52 for engagement with rail guides 66 of mounting block 67. Two terminals 68A and 68B are electrically connected on each side 70 of substrate 54 within recess 55 and are operably connecting Y-axis sensor assembly 29 within the electronic circuit shown in the FIG. 8.

The composition of energy absorber 57 can be selected from a spring, a wide variety of thermoset plastics, thermoplastics, natural and synthetic rubber. Examples of suitable materials include neoprene synthetic rubber and Sorbothane polyether based, polyurethane materials. The specific grades of the latter material that are particularly suitable as the material for absorber 57 include 30 Durometer Sorbothane, 50 Durometer Sorbothane and 30 Durometer Sorbothane polymers. Such materials effectively absorb the shock of a ball striking face 25 of head 24 and provide mechanical histeresis as discussed in more detail below.

Figure 1B:
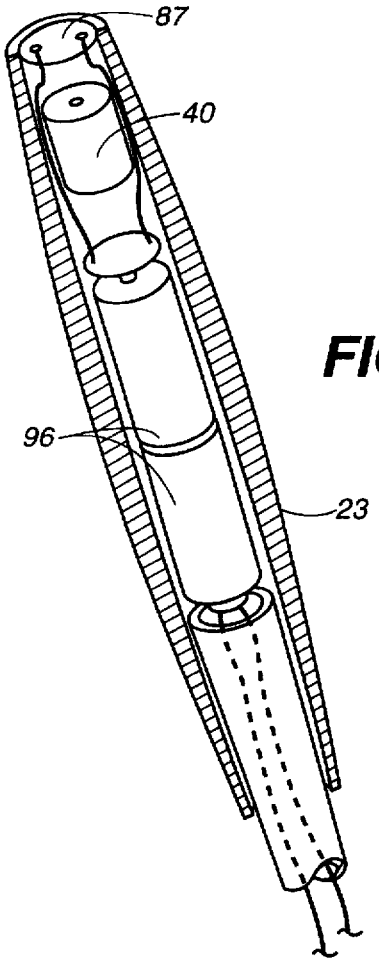
FIG. 1B is front perspective, exploded view, partially broken away to show the upper portion of the shaft of the putter of a preferred embodiment of the device of the present invention.
Figure 1A:
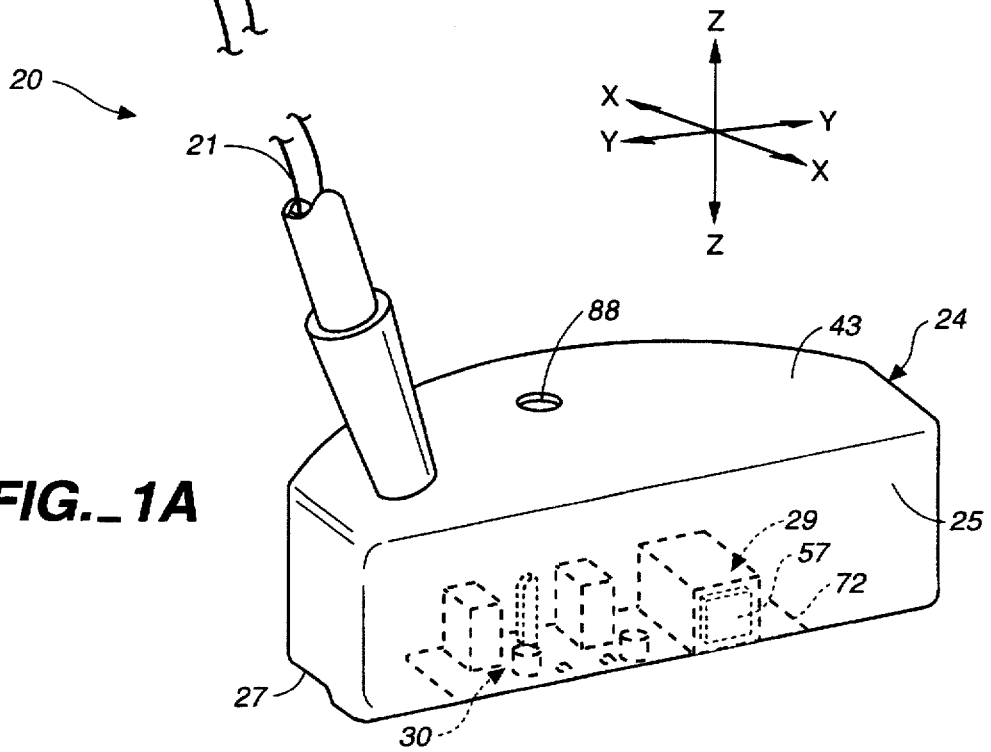
FIG. 1A is a top, front and left side perspective view of the lower section of a putting stroke training device of the present invention showing in dotted line the general placement of the major components of the device.
Figure 2:
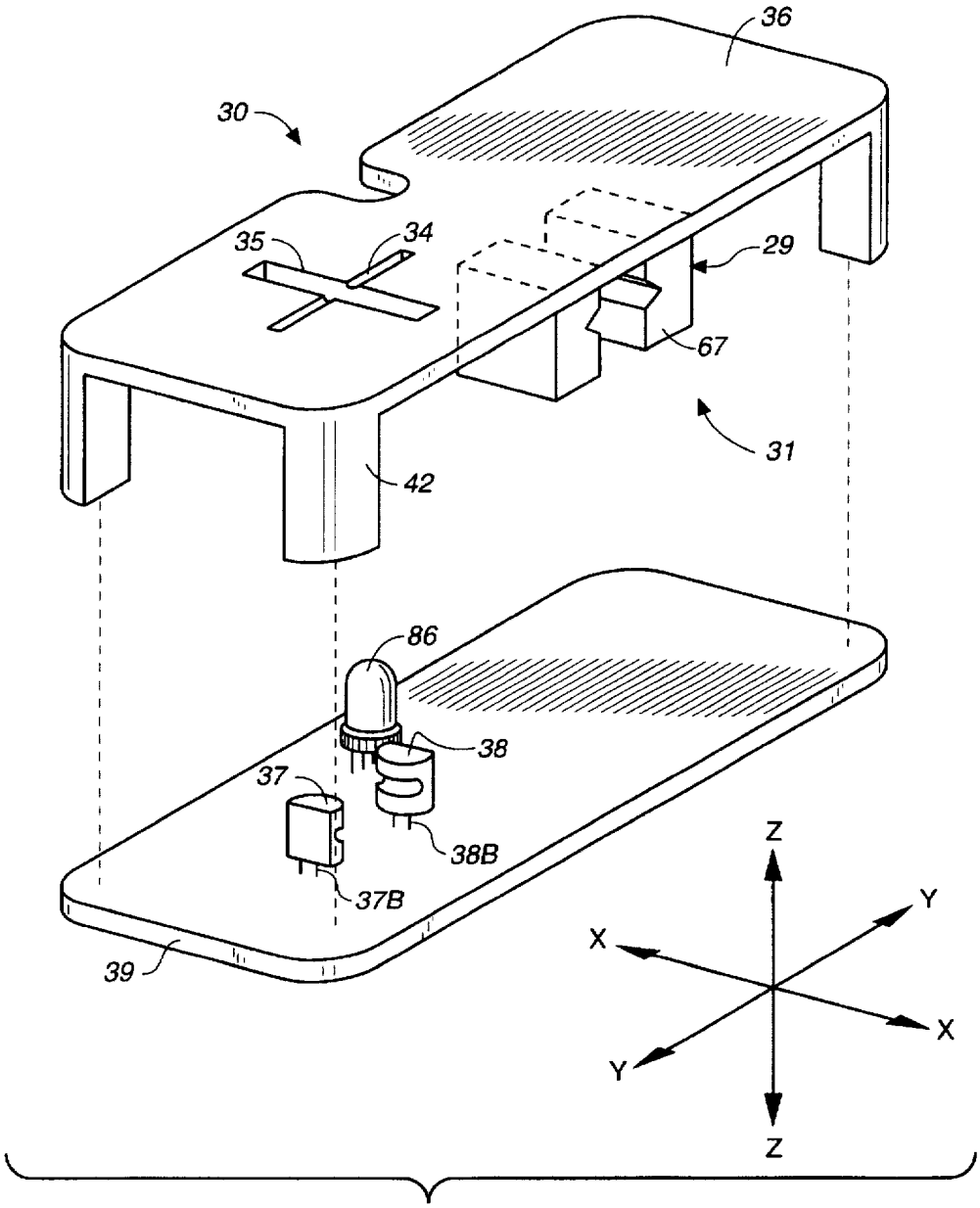
FIG. 2 is a top, front and left side perspective, exploded view of a module for housing the major components of a preferred embodiment of the device of the present invention, partially broken away to show the X-axis sensor and the Y-axis sensor.
Figure 2D:
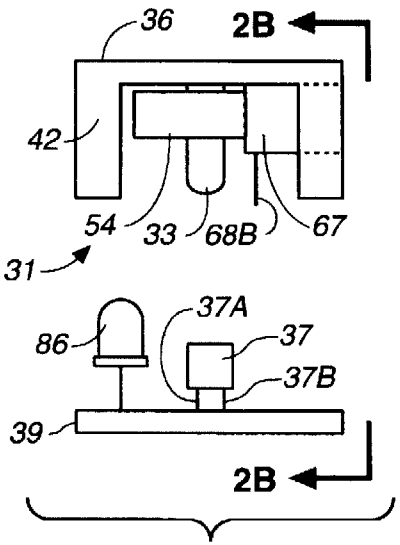
FIG. 2D is a left side view of the module shown in FIG. 2.
Figure 2A:
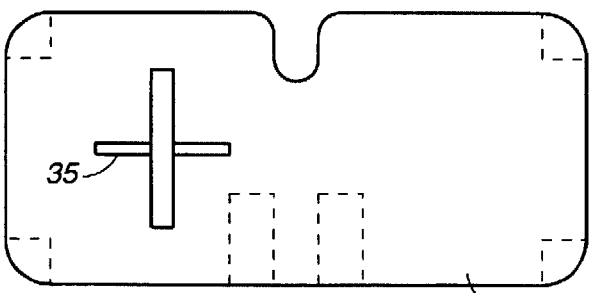
FIG. 2A is a top view of top of the module shown in FIG. 2.
Figure 2B:
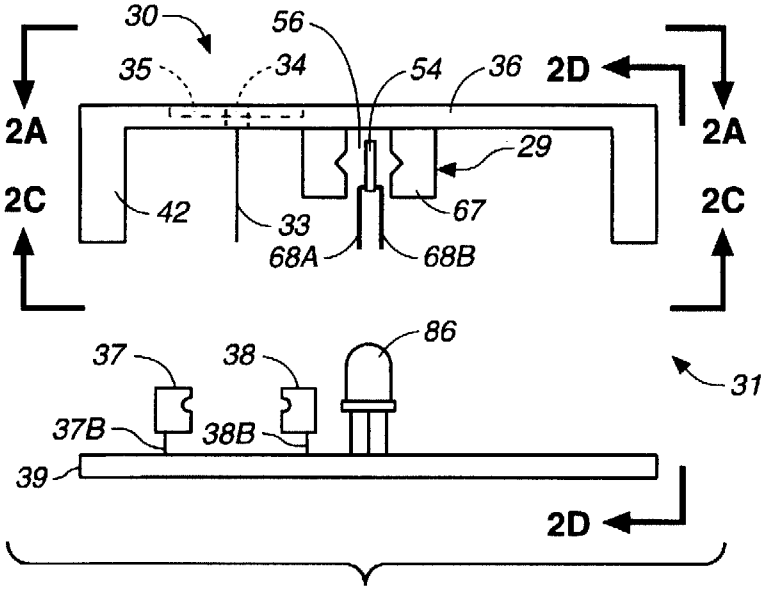
FIG. 2B is a rear view of the module shown in FIG. 2.
Figure 2C:
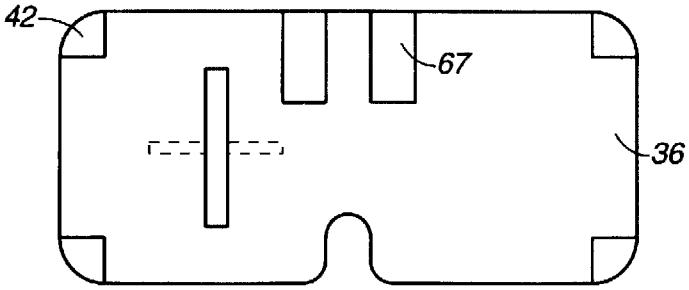
FIG. 2C is a bottom view of top of the module shown in FIG. 2.
Figure 3:
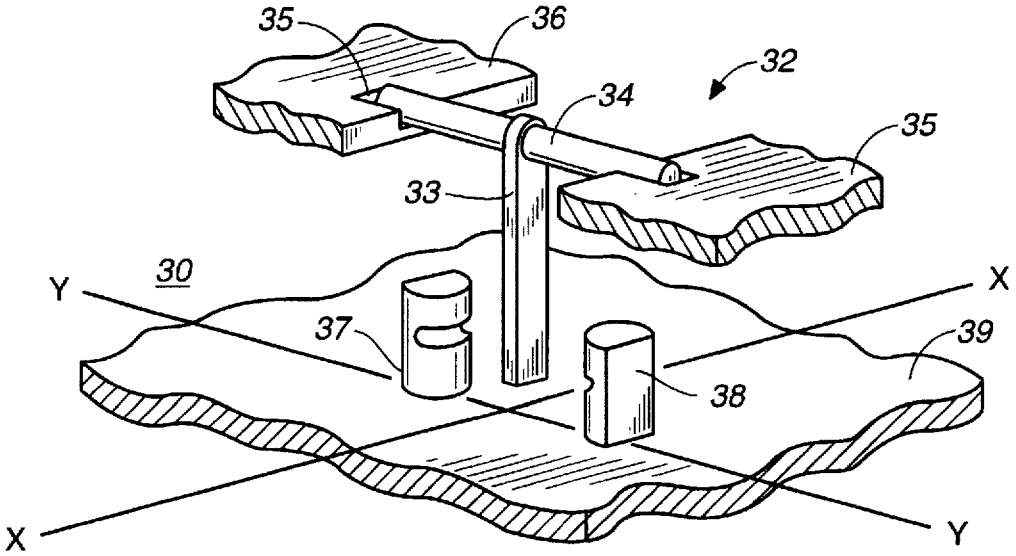
FIG. 3 is a top, front and right side perspective view of the X-axis sensor of a preferred embodiment of the device of the present invention.

Mounting block 67 has first end 72 affixed to the inside of striking face 25, second end 74 distal face 25, right side wall 76, left side wall 78, top side wall 80 and bottom rim 82. Top side wall 80 is integral with top 36 as shown in FIGS. 2B and 2D. Rails 64 of holder 52 are slidably engaged in rail guides 66 of block 67 so that energy absorber 57 is adjacent to first end 72 of block 67 and end 54B of substrate 54 extends from second end 74. As striking face 25 strikes the golf ball, the energy on the X-axis of the strike is partially absorbed by energy absorber 57. Most of the on-axis energy of the strike is absorbed by absorber 57. Any remaining energy, causes converter 53 to slide a slight distance along guide rails 66, which path is parallel to the path of striking face 25 of head 24 along the X-axis if the putting stroke is on-center. If most of this energy is absorbed in this manner, face 25 is perpendicular to the X-axis path of head 24 and red/green LED 86 stays green. The color of LED 86 is green as soon as ON/OFF switch 87 is switched on and is easily observed shining from opening 88 in top 43 of head 24 as the golfer looks down at the ball. On the other hand, if striking face 25 is open or closed, i.e., greater than 1° to the right or left of the X-axis, the rails transmit the energy to piezo-electric substrate 54 which is converted to electrical energy and passed through dual terminals 68A and 68B of the circuit shown in FIG. 8. When the impact of head 24 deviates from the X-axis, the detected energy generates sufficient current to turn the LED 86 from green to red as set forth in detail below. The red color of LED 86 is also easily observed shining from opening 88 in top 43 of head 24.

FIG. 7 shows an alternate embodiment of the putting stroke trainer of the present invention in which module 31 is mounted on top of any putter such as top 43 of putter 20 with shaft 21. Opening 90 is located directly over green/red LED 86. Module 31 is removably mounted using any suitable type of fastener or clip so that putter 20 can be used without the use of the trainer of this invention.

Figure 8:
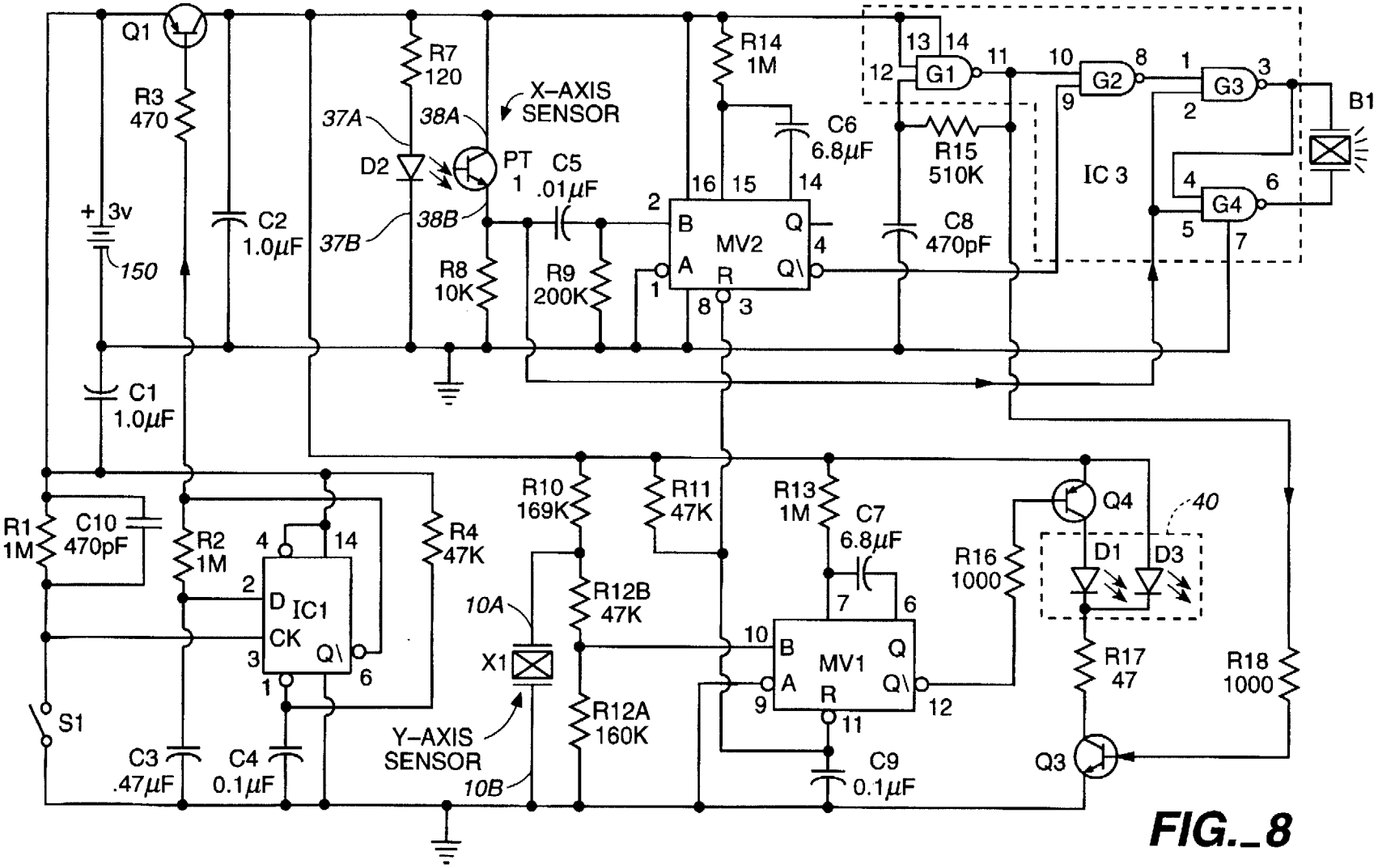
FIG. 8 is a block schematic diagram of an exemplary electronic circuit of the preferred embodiment of the present invention.

FIG. 8 is a block schematic diagram of an exemplary electronic circuit according to the present invention. An exemplary embodiment of emitter 37 of the X-axis sensor comprises a light emitting diode D2 and an exemplary embodiment of detector 38 comprises a photo-transistor PT1. Examples of a suitable light emitting diode D2 is BN505 and a suitable photo-transistor PT1 is PS505 sold by II Stanley Company. Appropriate terminal designations 30A, 30B, 31A, and 31B, are shown in FIG. 1. Y-axis sensor 29 is shown in FIGS. 2A–2D, 5A–5C and 6A–6B with its terminals 68A and 68B. An exemplary embodiment of the red/green light is shown at 86, and comprises a red light emitting diode D1 and a green light emitting diode D3. An exemplary red/green LED 86 is the TLRAG176 manufactured by the Toshiba Corporation.

The circuit shown in FIG. 8 is powered by two N battery cells 96, which are shown in FIG. 2B. The ON/OFF switch S1, shown in FIG. 1 as switch 87, is used to switch the electronic circuit ON and OFF. Switch S1 along with resistors R1–R4, capacitors C10, C3 and C4, D-type flip-flop IC1, and transistor Q1 operate to toggle power on and off to the remainder of the circuit each time switch S1 makes contact to its conduction terminals. An example of a suitable D-type flip-flop IC1 is a model 74VHC74 manufactured by National Semiconductor Corporation. Resistor R1 biases the clock input of flip-flop IC1 to the positive rail, and switch S1 is configured to ground the clock input of flip-flop IC1 each time it is in mode (closed). The flip-flop's complementary output Q\ is coupled to its D input by way of resistor R2, which sets the flip-flop in a toggle configuration. Each time a clock pulse occurs at the clock input, such as when switch S1 is closed, the Q\ output switches logic state (either from 0 to 1 or 1 to 0). The Q\ output terminal of flip-flop IC1 is coupled to PNP transistor Q1 via resistor R3, and renders Q1 conducting when the Q\ output is logic 0 and nonconducting when the Q\ output is logic 1. Capacitor C10 and resistor R1 provide debouncing of switch S1, and capacitor C3 and resistor R2 provide further debouncing by slowing the toggle change of the output Q\. Capacitor C4 and resistor R4 set flip-flop IC1 in a clear state upon initial application of power to the circuits, e.g., when battery cells 96, shown in FIG. 2B, are first inserted into the battery compartment at the grip end of the shaft.

As indicated above, Y-sensor 29 senses excess transverse vibration in club head 24, which indicates an off-center or off-axis contact between the golf ball and putter, and in response to excess vibration, turns off green diode D3 and turns on red diode D1. The green diode D3 is coupled between power and ground through resistor R17 and NPN transistor Q3. Transistor Q3 alternates between a conducting and non-conducting state at a relatively high frequency (e.g., above 1,000 Hz, and preferably around 4,000 Hz), and therefore drives diode D3 with pulsed power (so as to conserve energy). Transistor Q3 is driven through a resistor R18 by an oscillator circuit comprising a capacitor C8, a resistor R15, and a CMOS NAND gate G1 having Schmitt trigger inputs. The configuration of this oscillator is well known in the digital electronics arts. The output of the oscillator appears at the output of the NAND gate G1. It is also used to provide pulsed-power operation to buzzer B1, shown as buzzer 40 in FIG. 2B, in a similar manner and is coupled to buzzer B1 by way of three other NAND gates G2–G4, whose operation is described in further detail below. An example of a suitable NAND gate is a model 74HC132M manufactured by National Semiconductor Corporation, which provides four NAND gates in one package.

The green diode D3 is biased to normally emit light when the electronic circuit is ON. The exemplary embodiment shown in FIG. 8 is configured to switch the green diode D3 off when sufficient current is coupled to red diode D1. In the exemplary embodiment, the green diode D3 has a light-emitting voltage threshold which is higher than the emitting threshold of red diode D1 (e.g., 2.2 V versus 1.8 V). Once current is passed through red diode D1, it sets a voltage across resistor R17 which turns green diode D3 off. Current is passed through red diode D1 by turning on a PNP transistor Q4, which is coupled in series with red diode D1 to the supply voltage. Those skilled in the art will recognize that the turning-off of the green diode with the turning-on of the red diode is not a limitation on the scope of the present invention.

When an off-center or off-axis hit between the club face and a golf ball occurs, vibrations are generated in the piezo-electric substrate 54 of Y-sensor 29, which in turn generates an electrical signal between terminals 68A and 68B in relation to the magnitude of the vibrations. For the purposes of understanding the circuit shown in FIG. 8, the electrical equivalent circuit for Y-sensor 29 is a series combination of a capacitor and an AC voltage source between terminals 68A and 68B, with the output of the AC voltage source being in proportion to the magnitude of the vibrations. The output of Y-sensor 29 is coupled to the trigger terminal B of a mono-stable multivibrator MV1 though a resistor network formed by resistors R10, R12A, and R12B. An example of a suitable monostable multivibrator is a model 74VHC123 manufactured by National Semiconductor Corporation, which provides two such multivibrators per package. Multivibrator MV1 generates complementary output pulses at two outputs Q and Q\, respectively, whenever a rising edge pulse is coupled to trigger terminal B. The resistor network of resistors R10, R12A and R12B generates a voltage at terminal B which is just below the trigger voltage of multivibrator MV1. Y-sensor 29 is coupled into the network in such a manner that its AC output voltage is superimposed over the sub-trigger voltage level, thereby raising, the voltage at terminal B over the trigger point when vibrations occur. When multivibrator MV1 is triggered, a positive-going pulse is generated at its Q output and a negative-going pulse is generated at its Q\ output. Both pulses last for approximately the same time duration, which is set by a resistor R13 and a capacitor C7 to be approximately 5 seconds. The selection of value of these timing components is well known in the art. The Q\ output is coupled to the base of transistor Q4 by way of resistor R16. The negative-going pulse generated at the Q\ output when vibration occurs lowers the voltage at the base of transistor Q4, which sends current to red diode D1. Red diode D1 is lighted for approximately 5 seconds after an off-axis hit.

As indicated above, X-sensor 30 is used to detect an incorrect swing and to activate buzzer B1 when an incorrect swing has been detected. If pendulum 33 in X-sensor 30 swings to one side for a prolonged period of time, as for example during an incorrect back-swing, detector PT1 begins to conduct current to a resistor R8. Resistor R8 is coupled in series with photo-transistor PT1, with the combination coupled between power and ground. Likewise, a resistor R7 is coupled in series with diode D2, with the series combination being coupled between power and ground. Transistor PT1 is normally non-conducting (open) when pendulum 33 of X-sensor 30 blocks light from emitter 37 (diode D2). When the pendulum swings to one side and allows light from D2 to hit the base of transistor PT1, PT1 conducts current. A voltage in proportion to this current is generated across resistor R8 and coupled to inputs of NAND gates G3 and G4, which drive buzzer B1 with an oscillating signal generated by the oscillator formed by NAND gate G1, capacitor C8, and resistor R15. More specifically, the oscillating signal generated at the output of gate G1 is passed to gate G3 by way of gate G2, which acts to selectively block the oscillating signal under certain conditions described below. With the oscillating signal present at one input of gate G3, the oscillating signal is only passed to buzzer B1 when there is a significant voltage across resistor R8, which is coupled to an input of each of gates G3 and G4. The output of gate G3 is coupled to one terminal of buzzer B1 and to another input of gate G4. The output of gate G4 is coupled to the other terminal of buzzer B1. With a logic high signal from resistor R8, gate G3 passes the oscillating signal to buzzer B1, and gate G4 generates a complement of the oscillating signal at the buzzer's other terminal due to fact that the output of gate G3 is coupled to one of its inputs. Buzzer B1 is preferably, but not necessarily, a piezo-electric device which generates a sound wave having a frequency set by the frequency of the oscillating signal.

Under a proper club swing, pendulum 33 will continually block the light of diode D2 from transistor PT1 (thereby preventing buzzer B1 from sounding) until the putter hits the golf ball. Upon impact, the pendulum usually moves abruptly from its center position and oscillates across D2's light beam at a relatively high frequency, thereby causing transistor PT1 to conduct current. Under this condition of a proper swing, it is important that buzzer B1 not be activated, so as to indicate a proper swing after impact with the golf ball. To achieve this function, a blanking circuit comprising a monostable multivibrator MV2, two capacitors C5 and C6, and two resistors R9 and R14, is used to detect an abrupt movement in pendulum 33 and to thereafter interrupt the activation of buzzer B1 for a set period of time, typically 3 to 5 seconds. Capacitor C5 and resistor R9 of the blanking circuit form a high-pass filter (also called a differentiator) which detects abrupt changes in the voltage across resistor R8, as caused by abrupt changes in the current conducted by transistor PT1 and impact with the golf ball. When an abrupt change is detected, multivibrator MV2 generates a positive-going pulse at its Q output and a negative-going pulse at its Q\ output. The durations of these pulses are the same and are set by the values of capacitor C6 and resistor R14, as is well known in the art. The negative-going pulse from the Q\ output is coupled to one input of NAND gate G2. The other input of gate G2 receives the oscillator signal generated from the output of gate G1. Gate G2 passes the oscillating signal to gate G3 only when the voltage from the Q\ output of MV2 is high, which occurs whenever the pendulum has not abruptly moved. When the voltage from the Q\ output of MV2 is low during a negative-going pulse, gate G2 blocks the oscillating signal from being passed on to gate G3. An example of a suitable monostable multivibrator for MV2 is a model 74VHC123 manufactured by National Semiconductor Corporation. A resistor R11 and capacitor C9 are each coupled to the reset terminals of MV1 and MV2, and collectively place the multivibrators in a well-defined state upon power-up. Capacitors C1 and C2 provide supply-line filtering.

From the foregoing discussion of the electronic circuit diagram shown in FIG. 8, one skilled in the art recognizes that it is uniquely designed so that the circuitry can discriminate between the low frequency movement of pendulum actuator 32 during the backstroke, transition and forward stroke and the high frequency movement of pendulum actuator 32 during impact of striking face 25 with the golf ball. Therefore, irregular movement of actuator 32 at the instant of the ball strike is eliminated from electrical analysis made by the circuit. If the player has had a smooth backstroke, transition and forward stroke up until the time the ball is struck indicated by the low frequency of such movement, buzzer 40 will remain quiet.

EXAMPLE

A functional prototype of the putting trainer substantially the same as shown in FIGS. 1A–1B, 2, 2A–2D, 3, 5A–5C, 6A–6B and 8 was constructed by milling a solid block of aluminum to an aesthetically pleasing shape that was approximately 4.5" wide, by 2.1" deep, by 0.99" high. The striking face was cross-milled for good transfer of any tangential energy from the ball. A 0.375" hole was drilled in the top of the club and an Apollo Golf Shaft Model #LP/2377 was affixed by epoxy. This shaft was subsequently bent to achieve face balance (a standard practice). A cavity of 2.1" by 1" was milled into the bottom of the club head and a sole plate was machined to cover the cavity. A standard grip Lamkin Pro-Paddle Grip with the top cut off was used for the grip. A PCB having the dimensions of 2.1" by 1" by 0.05" was designed and fabricated to mount and interconnect the majority of electronic components shown in FIG. 8. The Y-axis sensor (shown in FIGS. 5A–5C and 6A–6B was fabricated using a 0.375" by 0.250" rectangular brass tube and was affixed to the inside of the striking face. The piezoceramic beam, 0.65" long by 0.25" high by 0.026" thick, was cut from a sample supplied by Morgan Matroc (Part #61329). The energy absorbing material, 0.15" wide by 0.3" high by 0.1" thick, was cut from a sample sheet supplied by Sorbathane material and affixed between the rear of striking face and the piezoceramic beam holder. The X-axis sensor was affixed to the top of the emitter and detector, allowing the pendulum to swing free between them. The fulcrum was made from brass eyelets and the pendulum was cut from a sheet of 0.01" brass shim stock. The battery and buzzer holder were fabricated from a piece of 0.5" brass tube, 5" long. The switch 87 was made by epoxying two brass eyelets to a plastic end cap of a grip supplied by Lamkin.

Without departing from the spirit and scope of this invention, one of ordinary skill in the art can make many other changes and modifications to the putting stroke training device of the present invention to adapt it to specific usages and conditions. All such changes and modifications are properly, equitably, and intended to be, within the full range of equivalents of the following claims.

What is claimed is:

1. A putting stroke training device comprising a golf putter including an elongated shaft and a head having a sole plate, a top and a golf ball striking face substantially perpendicular to said sole plate;

a module operably attached to said putter;

Y-axis sensor means disposed in a Y-plane that is perpendicular to an X-plane and to said ball striking face for giving a visual signal to the user when said face does not strike a golf ball perpendicular to the path of said head, and comprises first and second light emitting diodes connected in an electronic circuit, and an impact detecting means for interpreting the magnitude of vibrations depending on whether said striking face of said putter is in an open position, a closed position, or the proper position, said impact detecting means mounted within said module includes an energy absorber for absorbing mechanical energy, a pair of terminals operably connected to said electronic circuit, converter means for converting mechanical energy into electrical energy by generating an electrical signal across said pair of terminals in response to such vibrations, whereby, when said striking face is in the proper position and the ball hits against said striking face along the X-axis creating mechanical energy, said mechanical energy absorbing material absorbs and attenuates the mechanical energy and said electronic circuit maintains said first light emitting diode in an on-position and, when said striking face is in an open or a closed position and the ball does not hit against the striking face along the X-axis creating excess mechanical energy, said absorbing material fails to absorb an excess of mechanical energy and vibrations are generated in said converter means to be converted into sufficient current to cause said second light emitting diode to be in the on-position; and X-axis sensor means for detecting and signalling any abnormal acceleration or deceleration of said putter head, said X-axis sensor means being disposed in an X plane that is in the same plane as said shaft.

2. The putting stroke training device of claim 1 wherein said module contains a printed circuit board for said electronic circuit for operating said Y-axis sensor means and said X-axis sensor means.

3. The putting stroke training device of claim 1 wherein a switch means for activating said X-axis and Y-axis sensor means is operably connected to said X-axis and Y-axis sensor means and is mounted on said elongated shaft.

4. The putting stroke training device of claim 3 wherein said switch means is an ON/OFF switch and wherein said first light emitting diode is in the on-position when said switch is in the on-position.

5. The putting stroke training device of claim 4 wherein said switch means is an ON/OFF switch and wherein said first light emitting diode is in the off-position when said second light emitting diode is in the on-position.

6. The putting stroke training device of claim 5 wherein said first light emitting diode emits a pulse of light having a color distinguishable from the pulse emitted by said second light emitting diode and wherein said first light emitting diode has a light-emitting voltage threshold that is greater than that of said second light emitting diode.

7. The putting stroke training device of claim 1 wherein said X-axis means include a signaling means connected in said electronic circuit to give an audible signal to the user whether said head is accelerating or decelerating abnormally.

8. The putting stroke training device of claim 7 wherein said X-axis sensor means comprises an X-axis sensor electrical switch operably connected to an IR light pulse emitter, IR light pulse detector operably connected to said X-axis sensor electrical switch, a pendulum positioned within the path of light pulses between said emitter and said detector, and a fulcrum fixedly attached to said pendulum and rotatably mounted within said module, whereby an internal circuit of said electrical switch is completed when said pendulum moves out of the path of said pulses as a result of the user causing said putter head to move in other than a smooth pendulum-like stroke and activates said signaling means.

9. The putting stroke training device of claim 8 wherein said IR light pulse detector is a photo-transistor .

10. The putting stroke training device of claim 8 wherein said IR light pulse emitter is a light emitting diode.

11. The putting stroke training device of claim 10 wherein said module is mounted within said putter.

12. The putting stroke training device of claim 10 wherein said module is mounted on said top of said putter.

13. The putting stroke training device of claim 1 wherein said first and second light emitting diodes are operably connected to the top of said printed circuit board and are readily visible to the user during a putting stroke.

14. The putting stroke training device of claim 1 wherein said converter means comprises a holder and a piezo-electric substrate partially within said holder for generating an electrical signal in relation to the magnitude of energy generated when said ball striking face is in an open or a closed position.

15. The putting stroke training device of claim 14 wherein said holder has first and second ends respectively proximal and distal to said ball striking face, a longitudinal axis extending through said ends, first and second side walls and top and bottom side walls, wherein said piezo-electric substrate is operably mounted within said holder and extends from said second end and wherein said pair of terminals are operably connected between said substrate and said internal circuit.

16. The putting stroke training device of claim 15 wherein said energy absorber is affixed to the first end of said holder and adjacent to the inside surface of said golf ball striking face.

17. The putting stroke training device of claim 16 wherein said energy absorber is selected from the group consisting of a spring, thermoset plastics, thermoplastics, natural rubber, and synthetic rubber.

18. The putting stroke training device of claim 15 wherein each of said first and second side walls of said holder has a rail parallel to said longitudinal axis, and wherein said mounting block has a pair of rail guides for receiving each of said rails to allow free movement of said holder along said longitudinal axis and perpendicular to said ball striking face.

19. A putting stroke training device comprising a golf putter including an elongated shaft and a head having a sole plate, a top and a ball striking face substantially perpendicular to said sole plate;

a module operably attached to said putter;

Y-axis sensor means disposed in a Y-plane that is perpendicular to an X-plane and to said ball striking face for giving a visual signal to the user when said face does not strike a golf ball perpendicular to the path of said head, and comprises first and second light emitting diodes connected in an electronic circuit, and an impact detecting means for interpreting the magnitude of vibrations depending on whether said striking face of said putter is in an open position, a closed position, or the proper position, and a mounting block mounted within said module, said impact detecting means mounted to said mounting block includes a holder having first and second ends, an energy absorber affixed to the first end, a pair of terminals operably connected to said electronic circuit, a piezo-electric substrate partially within said holder for generating an electrical signal across said pair of terminals in response to the magnitude of vibrations generated when said ball striking face is in an open or a closed position, whereby when said striking face is in the proper position and the ball hits against said striking face along the X-axis creating mechanical energy, said mechanical energy absorbing material absorbs and attenuates the mechanical energy and said electronic circuit maintains said first light emitting diode in an on-position and, when said striking face is in an open or a closed position and the ball does not hit against the striking face along the X-axis creating excess mechanical energy, said absorbing material fails to absorb an excess of mechanical energy and vibrations are generated in said converter means to be converted into sufficient current to cause said second light emitting diode to be in the on-position; and said X-axis sensor means comprises an X-axis sensor electrical switch operably connected to an IR light pulse emitter, a signaling means connected in said electronic circuit to give an audible signal to the user whether said head is accelerating or decelerating abnormally, IR light pulse detector operably connected to said X-axis sensor electrical switch, a pendulum positioned within the path of light pulses between said emitter and said detector, and a fulcrum fixedly attached to said pendulum and rotatably mounted within said module, whereby an internal circuit of said electrical switch is completed when said pendulum moves out of the path of said pulses as a result of the user causing said putter head to move in other than a smooth pendulum-like stroke and activates said signaling means.

20. The putting stroke training device of claim 19 wherein said module is mounted within said putter.

21. The putting stroke training device of claim 19 wherein said module is mounted on said top of said putter.

22. The putting stroke training device of claim 19 wherein said module contains a printed circuit board for said electronic circuit.

23. The putting stroke training device of claim 19 wherein a switch means for activating said X-axis and Y-axis sensor means is operably connected to said X-axis and Y-axis sensor means and is mounted on said elongated shaft.

24. The putting stroke training device of claim 23 wherein said switch means is an ON/OFF switch and wherein said first light emitting diode is in the on-position when said switch is in the on-position.

25. The putting stroke training device of claim 24 wherein said switch means is an ON/OFF switch and wherein said first light emitting diode is in the off-position when said second light emitting diode is in the on-position.

26. The putting stroke training device of claim 25 wherein said first light emitting diode emits a pulse of light having a color distinguishable from the pulse emitted by said second light emitting diode and wherein said first light emitting diode has light-emitting voltage threshold that is less than that of said second light emitting diode.

27. The putting stroke training device of claim 19 wherein said IR light pulse detector is a photo-transistor.

28. The putting stroke training device of claim 27 wherein said IR light pulse emitter is a light emitting diode.

29. The putting stroke training device of claim 19 wherein said first and second light emitting diodes form a single light emitting source mounted on the top of said printed circuit board which is readily visible to the user during a putting stroke.

30. The putting stroke training device of claim 19 wherein said energy absorber is selected from the group consisting of a spring, thermoset plastic, thermoplastic, natural rubber, and synthetic rubber.

31. The putting stroke training device of claim 19 wherein each of said first and second side walls of said holder has a rail parallel to said longitudinal axis, and wherein said mounting block has a pair of rail guides for receiving each of said rails to allow free movement of said holder along said longitudinal-axis and perpendicular to said ball striking face.

32. The putting stroke training device of claim 31 wherein said energy absorber abuts said ball striking face.

33. A putting stroke training device comprising a golf putter including an elongated shaft and a head having a sole plate, a top and a ball striking face substantially perpendicular to said sole plate;

a module operably attached to said putter;

Y-axis sensor means disposed in a Y-plane that is perpendicular to an X-plane and to said ball striking face for giving a visual signal to the user when said face does not strike a golf ball perpendicular to the path of said head, and comprises first and second light emitting diodes connected in an electronic circuit, and an impact detecting means for interpreting the magnitude of vibrations depending on whether said striking face of said putter is in an open position, a closed position, or the proper position, and a mounting block mounted within said module, said impact detecting means mounted to said mounting block includes a holder having first and second ends, an energy absorbing material affixed to the first end, a pair of terminals operably connected to said electronic circuit, a piezoelectric substrate partially within said holder for generating an electrical signal across said pair of terminals in response to the magnitude of vibrations generated when said ball striking face is in an open or a closed position, whereby, when said striking face is in the proper position and the ball hits against said striking face along the X-axis creating mechanical energy, said mechanical energy absorbing material absorbs and attenuates the mechanical energy and said electronic circuit maintains said first light emitting diode in an on-position and, when said striking face is in an open or a closed position and the ball does not hit against the striking face along the X-axis creating excess mechanical energy, said absorbing material fails to absorb an excess of mechanical energy and vibrations are generated in said converter means to be converted into sufficient current to cause said second light emitting diode to be in the on-position; and said X-axis sensor means disposed in an X-plane that is perpendicular to the Y-plane and is in the same plane as said shaft, and said X-axis sensor means comprises an X-axis sensor electrical switch operably connected to an IR light pulse emitter, a signaling means connected in said electronic circuit to give an audible signal to the user whether said head is accelerating or decelerating abnormally, IR light pulse detector operably connected to said X-axis sensor electrical switch, a spring having a weight at one end thereof positioned within the path of light pulses between said emitter and said detector, and a stationary arm fixedly attached to the other end of said spring and mounted within said module, whereby an internal circuit of said electrical switch is completed when said spring moves out of the path of said pulses as a result of the user causing said putter head to move in other than a smooth pendulum-like stroke and activates said signaling means.

* * * * *